US007154062B2

(12) United States Patent
Asakawa et al.

(10) Patent No.: US 7,154,062 B2
(45) Date of Patent: Dec. 26, 2006

(54) CIRCUIT BREAKER

(75) Inventors: Koji Asakawa, Saitama-ken (JP); Mitsuhiro Mitsushige, Saitama-ken (JP); Yasuhiro Takahashi, Ohtawara (JP); Akifumi Sato, Saitama (JP); Hisanobu Asano, Saitama-ken (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 11/314,531

(22) Filed: Dec. 22, 2005

(65) Prior Publication Data

US 2006/0191873 A1 Aug. 31, 2006

(30) Foreign Application Priority Data

Feb. 25, 2005 (JP) ..... 2005-050268

(51) Int. Cl.
*H01H 33/02* (2006.01)

(52) U.S. Cl. ..... 218/155; 335/202; 335/8

(58) Field of Classification Search ..... 218/155, 218/157; 335/8–16, 132, 202; 200/48 R, 200/49, 295–308, 244–246
See application file for complete search history.

(56) References Cited

U.S. PATENT DOCUMENTS 4,679,019 A * 7/1987 Todaro et al. ..... 335/172
5,258,729 A * 11/1993 Link et al. ..... 335/202
5,266,760 A * 11/1993 Link et al. ..... 200/244
5,907,461 A * 5/1999 Hartzel et al. ..... 335/18
6,172,586 B1 * 1/2001 Ferree et al. ..... 335/202

FOREIGN PATENT DOCUMENTS

WO WO01/041168 6/2001

* cited by examiner

*Primary Examiner*—Elvin Enad
*Assistant Examiner*—M. Fishman
(74) *Attorney, Agent, or Firm*—Manabu Kanesaka

(57) ABSTRACT

A circuit breaker has a molded case with a main case, a middle cover and a top cover being dividable from one another. The main case contains contactor sections, each including a stationary contactor and a movable contactor for a pole corresponding to each phase in a polyphase circuit, an arc-extinguishing device, an overcurrent tripping device actuating a tripping mechanism by detecting an overcurrent, and a zero-phase current transformer detecting a leak current. The middle cover has a partitioned recess for containing a switching mechanism and the tripping mechanism. Interpole partitions, surrounding the contactor section and the arc-extinguishing device, and a screen-like intermediate partition, isolating the contactor sections from the overcurrent tripping device, are formed with the middle cover laid on the main case. A wall with gas outlets for an arc gas is provided on the back of the arc-extinguishing devices.

5 Claims, 2 Drawing Sheets

CIRCUIT BREAKER

BACKGROUND OF THE INVENTION AND RELATED ART STATEMENT

The present invention relates to a circuit breaker covering a breaker such as a molded-case circuit breaker or a ground leakage breaker.

As is well known, the above-described circuit breaker is made up of contactor sections, each corresponding to each phase in a main circuit as a multi-phase circuit and including a stationary contactor and a movable contactor, arc-extinguishing devices for the respective contactor sections, a switching mechanism driving the movable contactors for switching, a tripping mechanism for the switching mechanism, and an overcurrent tripping device actuating the tripping mechanism by detecting an overcurrent, which are assembled together in a molded case (see, for example, JP-A-5-211024).

In the circuit breaker with the above arrangement, interruption of an overcurrent such as a short-circuit current causes an arc to occur between a stationary contact and a movable contact in the main circuit. The heat of the arc causes metals of materials of the contacts to melt and evaporate. The evaporated molten metals are scattered around with an arc gas to be deposited on movable parts of the switching mechanism and the tripping mechanism, which sometimes causes deterioration in the function of their interruption action. Moreover, an arc gas, produced at current interruption, spreading over poles and flowing in between the poles causes a decrease in interphase breakdown strength to also cause a problem of making it impossible to obtain a high interruption performance. Particularly in a ground leakage breaker, a zero-phase current transformer in a leakage current detection section is contained in the molded case while being arranged next to the back of contactor sections in all poles. This structurally makes it difficult to isolate the poles from one another, by which the arc gas is liable to go around between the poles through the containing space.

About this, the following structure is known as a measure for preventing molten metals, produced at contactor sections at interruption of an overcurrent and scattered around, from being deposited on mechanisms such as a switching mechanism (see, for example, JP-X-2001-41168). In the structure, a contactor section and an arc-extinguishing device for each of the poles are contained in an independently provided arc-extinguishing chamber case enclosing them to be provided as a unit. With the unit being contained in a molded case of a circuit breaker together with other units to make the poles isolated from one another, a switching mechanism is made linked with a movable contactor in each of the units in the molded case.

In addition to the structure disclosed in JP-X-2001-41168, there is known a circuit breaker having a simple assembly structure for ensuring the shielding of a switching mechanism from molten metals scattered around by heat of an arc. In the assembly structure, a molded case of the circuit breaker is made to have a structure being dividable into a main case (a lower case), a middle cover laid on the top of the main case, and a top cover covering the top of the middle cover. The main case contains contactor sections, arc-extinguishing devices, and an overcurrent tripping device. The middle cover has a recess, partitioned with a wall, formed in the central section thereof to contain the switching mechanism and a tripping mechanism in the recess.

The above-described circuit breakers with related structures have the following problems. In the assembly structure disclosed in JP-X-2001-41168, the isolated arc extinguishing-chamber case, which is independently prepared for each pole and mounted in the molded case, increases the number of assembled parts and man-hours for assembly, which results in an increased cost. In the arrangement in which the molded case is made to have a dividable structure, the switching mechanism, being contained in the recess in the middle cover to be isolated from the contactor sections and the arc-extinguishing devices, can only be prevented from the molten metals, scattered around from the contactor sections along with current interruption, depositing on the switching mechanism. The arrangement as it is, however, provides a space, containing the overcurrent tripping device and the zero-phase current transformer of the ground leakage breaker arranged next to the back of the contactor sections in the main case, as a circuitous path for an arc gas produced at current interruption. Therefore, the arrangement can not solve the problem yet in which an arc gas produced at current interruption goes around between poles to cause a decrease in interphase breakdown strength.

The present invention was made in view of the foregoing with an object of providing a circuit breaker in which the structure of a molded case is improved so as to inhibit deterioration in interphase insulation due to a going around arc gas to enhance interruption performance and reliability of the circuit breaker.

Further objects and advantages of the invention will be apparent from the following description of the invention and the associated drawings.

SUMMARY OF THE INVENTION

In order to achieve the above object, according to the invention, a circuit breaker includes: contactor sections each provided for a pole corresponding to each phase in a polyphase circuit, each of the contactor sections including a stationary contactor and a movable contactor; arc-extinguishing devices for the respective contactor sections; a switching mechanism driving the movable contactors for switching; a tripping mechanism for the switching mechanism; an overcurrent tripping device actuating the tripping mechanism by detecting an overcurrent; and a molded case including: a main case containing the contactor section and the arc-extinguishing device for each pole and the overcurrent tripping device; a middle cover laid on the main case, the middle cover having a recess, partitioned with a wall, formed at the central section thereof for containing the switching mechanism and the tripping device; and a top cover covering the top of the middle cover, wherein the main case, the middle cover and the top cover are arranged to be dividable from one another.

The molded case is made to have a structure in which interpole partitions, surrounding the contactor section and the arc-extinguishing device for each of the poles to isolate the section and the device from others, and a screen-like intermediate partition, isolating the contactor sections from the overcurrent tripping device arranged next to the contactor sections on the back thereof, are formed with the middle cover being laid on the main case, and in which a wall having gas outlets opened toward the outside of the molded case is provided on the back of the arc-extinguishing devices.

Specifically, the interpole partitions and the intermediate partition are embodied in the following arrangement.

(1) Each of the interpole partitions includes a section integrally provided with the main case and a section integrally provided with the middle cover, and the respective sections are made to be abutted against each other to form each of the interpole partitions with the middle cover being laid on the main case.

(2) The intermediate partition is integrally provided with the middle cover, and brought into contact with the end of each of the interpole partitions in the main case across the poles with the middle cover being laid on the main case to shield the contactor sections and the overcurrent tripping device from each other.

With the above arrangement, a containing space for arranging the contactor section and the arc-extinguishing device is individually partitioned for each pole by the main case and the middle cover of the molded case, the interpole partitions and the intermediate partition. The individually partitioned containing space is opened to the outside of the case only through the gas outlets opened in the back wall of the arc-extinguishing device. Moreover, the switching mechanism is isolated from the contactor section in each pole by the partitions forming the recess in the middle cover. Furthermore, the overcurrent tripping device and a zero-phase current transformer for detecting a leak current mounted next to the overcurrent tripping device, both arranged in a space in the case at the back of the switching mechanism with the screen-like intermediate partition provided between, are also isolated from the contactor sections in the same way.

This allows molten metals and an arc gas, produced in the contactor section at interruption of an overcurrent, to be discharged outside of the case through the gas outlets opened in the back wall of the arc extinguishing device. Therefore, there is no fear of causing the molten metals to deposit on the switching mechanism, the tripping mechanism and the overcurrent tripping device. Moreover, the arc gas is inhibited from going around among the pole units, which can prevent deterioration of interphase insulation to enhance interruption performance and reliability of the breaker. In addition, the interpole partitions, integrally molded with the main case of the molded case, and the interpole partitions and the intermediate partition, integrally molded with the middle cover of the molded case, enable a product to be assembled with man-hours equivalent to those in related art without increasing the number of parts and without enlarging the external size of the circuit breaker.

DETAILED DESCRIPTION OF THE PREFERRED EMBODIMENTS

Figure 1A:
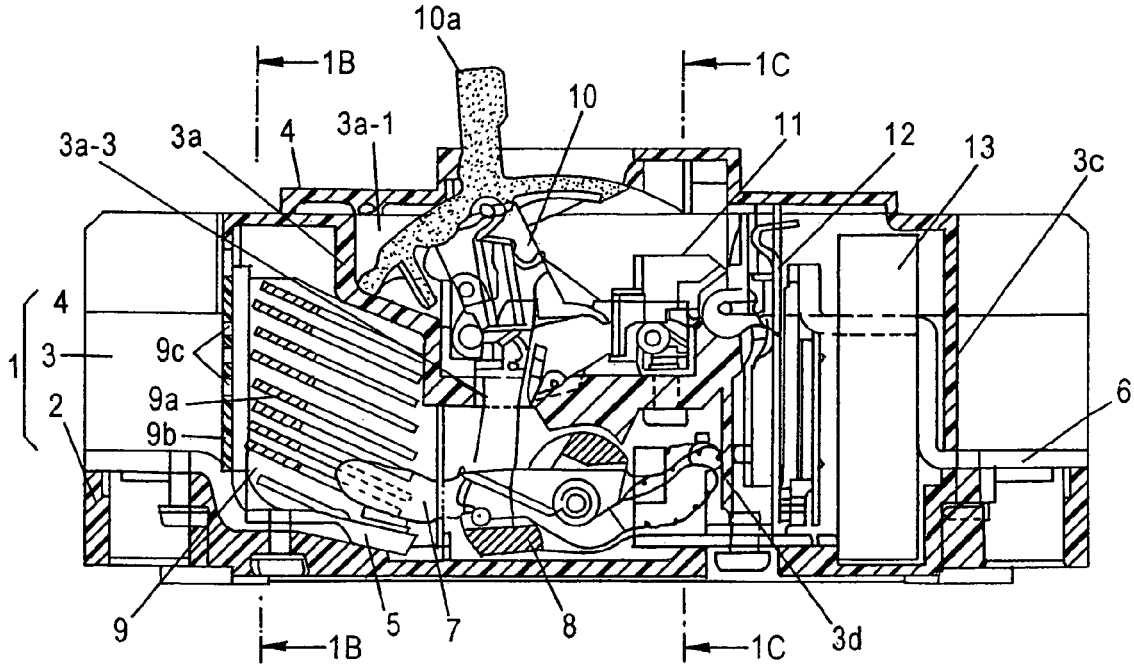
FIG. 1A is a side cross-sectional view showing the inside structure of a three-phase ground leakage breaker as an embodiment of the circuit breaker according to the invention.

In the following, an embodiment of the invention will be explained on the basis of FIGS. 1A to 1C, FIG. 2 and FIG. 3 showing a three-phase ground leakage breaker taken as an example of a circuit breaker. In the example of the ground leakage breaker shown in the figures, reference number 1 denotes a molded case with a structure dividable into a main case (a lower case) 2, a middle cover 3 and a top cover 4. Reference numbers 5, 6 and 7 denote a stationary contactor integral with a power supply side terminal, a load side terminal and a movable contactor, respectively. Reference number 8 denotes a contactor holder rotatably holding the movable contactor 7. Reference numbers 9, 10 and 10*a* denote an arc-extinguishing device, a toggle link switching mechanism and a switching operation lever, respectively. Reference number 11 denotes a tripping mechanism linked to the switching mechanism 10 by making a latch receiver linked to a trip cross bar for normally making a latch of the switching mechanism 10 engaged to keep a switching spring in an energized state.

Reference number 12 denotes an overcurrent tripping device that detects an overcurrent in a main circuit to actuate the tripping mechanism 11, and reference number 13 denotes a zero-phase current transformer mounted in the ground leakage breaker for detecting a leak current in the main circuit. The switching operation and the current interruption operation of the circuit breaker are well known, so that explanations about them will be omitted here.

Figure 1B:
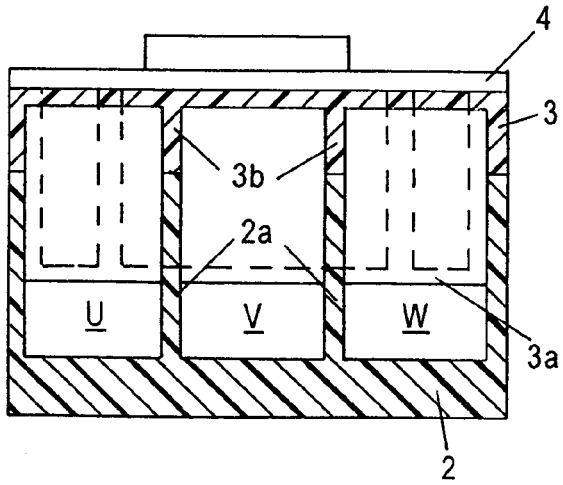
FIG. 1B is a schematic cross-sectional view taken in the direction of the arrows along the line 1B–1B of FIG. 1A.
Figure 1C:
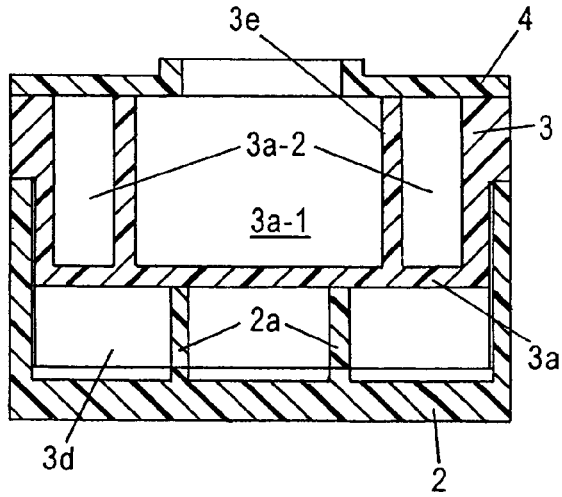
FIG. 1C is a schematic cross-sectional view taken in the direction of the arrows along the line 1C–1C of FIG. 1A.
Figure 2:
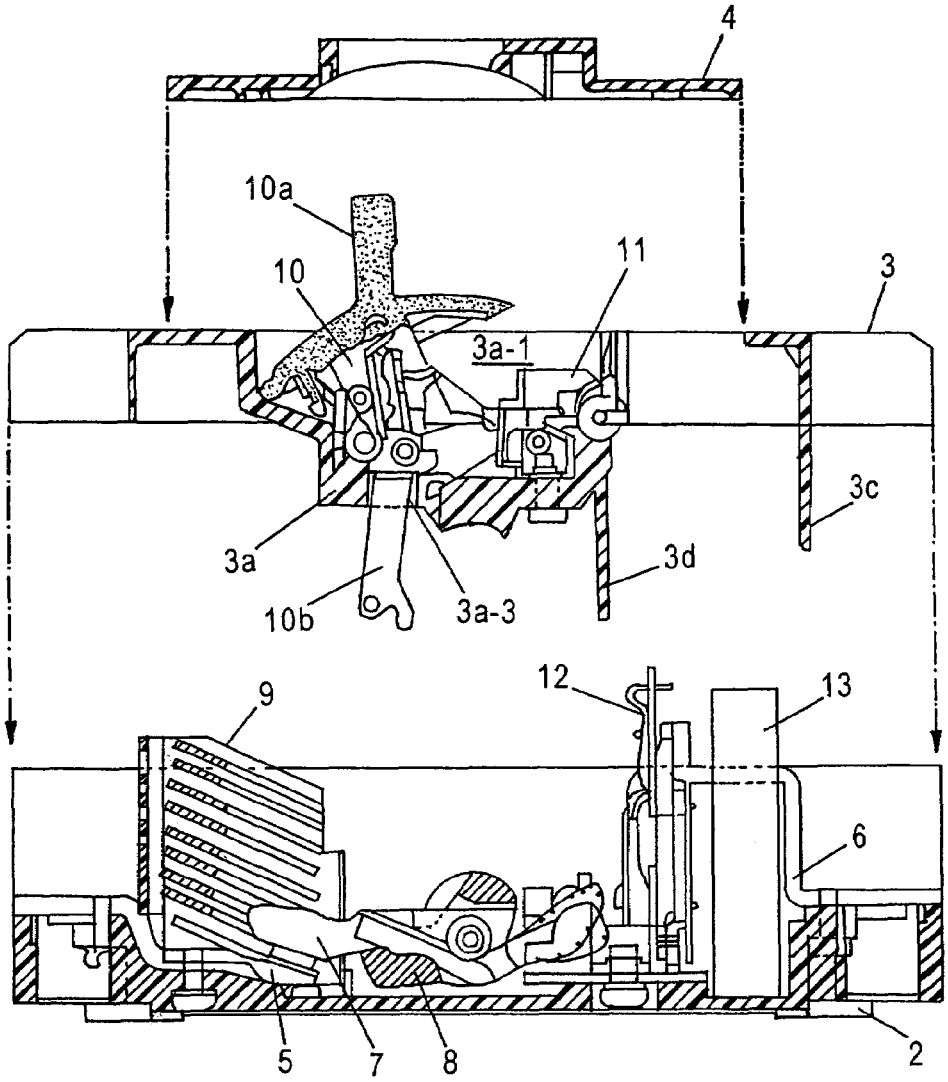
FIG. 2 is an exploded cross-sectional view separately showing the main case, the middle cover and the top cover of the structure shown in FIG. 1A.

Here, in the main case 2 of the molded case 1, three units, each including the stationary contactor 5, the movable contactor 7 and the arc-extinguishing device 9 for each of poles corresponding to respective phases of U, V and W, are arranged in parallel in the lateral direction. On the back of the units, the overcurrent tripping device (thermal device) 12 and the zero-phase current transformer 13 are arranged between the load side terminals 6. Moreover, as shown in FIGS. 1B and 1C, on the power supply side terminal side of the main case 2, two rib-like interpole partitions 2*a* are formed in a region in which the stationary contactors 5, the movable contactors 7 and the arc-extinguishing devices 9 are arranged. The rib-like interpole partitions 2*a* are formed so as to isolate the units, corresponding to the respective phases of U, V and W, from one another each of which units includes the stationary contactor 5, the movable contactor 7 and the arc-extinguishing device 9 for each pole.

Figure 3:
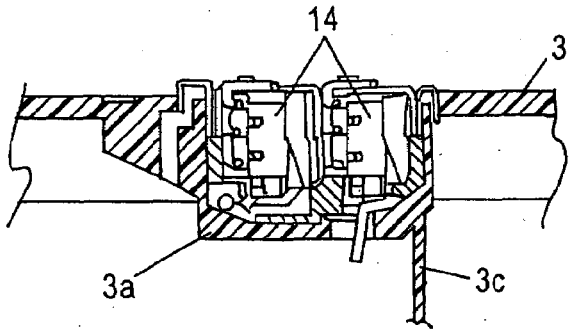
FIG. 3 is a cross-sectional view showing a state of attachments being mounted in a recess inside the middle cover.

Meanwhile, the middle cover 3 mounted on the top of the main case 2 has a pocket-like recess 3*a* formed at the central section with a wall provided around the recess for partitioning. With the inside of the recess 3*a* divided into a central chamber 3*a*-1 and a right-hand and left-hand chambers 3*a*-2 (see FIG. 1C) by inner walls 3*e*, the switching mechanism 10 and the tripping mechanism 11 are to be contained in the central chamber 3*a*-1. Moreover, in the right-hand and left-hand chambers 3*a*-2, interior attachments 14 such as an auxiliary switch, an alarm switch and a voltage tripping device are to be contained as shown in FIG. 3. Furthermore, a slit 3*a*-3 is opened in the bottom wall of the recess 3*a*. Through the slit 3*a*-3, the lower toggle link of the switching mechanism 10 is made to project downward to be coupled to the contactor holder 8 of the movable contactor 7.

On the power supply side terminal side of the middle cover 3, two rib-like interpole partitions 3*b* are integrally formed downward. With the middle cover 3 being assembled with the main case 2 while being laid thereon, each of the interpole partitions 3*b* is made to be abutted against each of the corresponding interpole partitions 2*a* in the main case 2 so that the poles are isolated from one another. Furthermore, on the load side terminal side, an end wall 3*c* having a width corresponding to the whole width of the main case 2 and a screen-like intermediate partition 3*d* hanging downward from the recess 3*a* are integrally formed. With the end wall 3*c* and the intermediate partition 3*d*, a space for containing the overcurrent tripping device 12 and the zero-phase current transformer 13 is partitioned from both of the front and back sections. Along with this, the face of the intermediate partition 3*d* makes contact with the rear end faces of the interpole partitions 2*a* in the main case 2 to close the end of a space for containing the contactor sections of each pole.

Furthermore, on the top of the middle cover 3, the top cover 4 is mounted to cover the top of the recess 3. The top cover 4 has an opening at its center so that the switching operation lever 10*a* of the switching mechanism 10 is made to project outside through the opening.

Moreover, the arc-extinguishing device 9 contained in the main case 1 is arranged on the power supply side terminal side of the main case 1. The arc-extinguishing device 9 is assembled to have a structure in which grids 9*a* are arranged in parallel with one another along the opening path of the movable contactor 7 and surrounded with insulator partitions on their right-hand, left-hand and back sides. In a wall 9*b* as the partition on the back side, gas outlets 9*c* are opened for discharging arc gas produced at current interruption.

With the above assembled structure, in each pole, the contactor section, including the stationary contactor 5 and the movable contactor 7, and the arc-extinguishing device 9 are surrounded with the main case 2 and the middle cover 3 in the molded case 1, the interpole partitions 2*a* in the main case 2, the interpole partitions 3*b* in the middle case 3 and the intermediate partition 3*d* in the middle cover 3. This makes the contactor section and the arc-extinguishing device 9 in each pole isolated from those in the other poles with each space containing the contactor section opened to the outside of the case only through the gas outlets 9*c* opened in the wall 9*b* on the back of the arc-extinguishing device 9. Moreover, the switching mechanism 10, the tripping mechanism 11 and the interior attachments 14 are isolated from the contactor sections by the wall partitioning the recess 3*a* in the middle cover 3. Furthermore, the overcurrent tripping device 12 and the zero-phase current transformer 13 contained on the load side terminal side are shielded from the contactor sections by the intermediate partition 3*d* hanging from the middle cover 3.

This eliminates an arc gas, produced in the contactor sections at interruption of an overcurrent, going around between the poles or flowing into the space containing the overcurrent tripping device 12 and the zero-phase current transformer 13. Thus, the arc gas is made to wholly flow toward the arc-extinguishing device 9 and to be discharged outside through the gas outlets 9*c* provided on the back side of the arc extinguishing device 9. Therefore, no molten metals, produced by heat of an arc, deposit on the switching mechanism 10 and the tripping mechanism 11 and prevent their operation. Moreover, there arises no fear of causing deterioration of interphase insulation by the arc gas going around. Therefore, high interruption performance and reliability can be ensured.

In addition, the interpole partitions 2*a* integrally molded with the main case 2 of the molded case 1, and the interpole partitions 3*b* and the intermediate partition 3*d* integrally formed with the middle cover 3 of the molded case 1 enable the circuit breaker to be assembled without increasing the number of assembled parts and man-hours for assembly. Here, a ground leakage breaker was taken as the example of a circuit breaker shown in the figures. However, the invention can of course be embodied in the same way with respect to a molded-case circuit breaker.

While the present invention has been particularly shown and described with reference to the preferred embodiment thereof, it will be understood by those skilled in the art that the foregoing and other changes in form and details can be made therein without departing from the spirit and scope of the present invention.

The disclosure of Japanese Patent Application No. 2005-050268 filed on Feb. 25, 2005, is incorporated herein.

What is claimed is:

1. A circuit breaker comprising:

contactor sections for poles corresponding to phases in a multi-phase circuit, each of the contactor sections comprising a stationary contactor and a movable contactor;

arc-extinguishing devices for the respective contactor sections;

a switching mechanism driving the movable contactors for switching;

a tripping mechanism for the switching mechanism;

an overcurrent tripping device actuating the tripping mechanism by detecting an overcurrent; and a molded case including a main case containing the contactor section and the arc-extinguishing device for each pole and the overcurrent tripping device; a middle cover disposed on the main case, the middle cover having a recess, partitioned with a wall, formed at a central section thereof for containing the switching mechanism and the tripping device; and a top cover covering the top of the middle cover, said main case, the middle cover and the top cover being arranged to be dividable from one another, wherein the molded case has interpole partitions, surrounding the contactor section and the arc-extinguishing device for each of the poles, for isolating said section and said device from other sections and devices, and an intermediate partition for isolating the contactor sections from the overcurrent tripping device arranged next to the contactor sections on a back thereof, and a wall, provided on a back of the arc-extinguishing devices, having gas outlets opening to an outside of the molded case.

2. The circuit breaker as claimed in claim 1, wherein the interpole partitions and the intermediate partition are formed by the middle cover being disposed on the main case.

3. The circuit breaker as claimed in claim 2, wherein each of the interpole partitions comprises a first section integrally provided with the main case, and a second section integrally provided with the middle cover, said respective first and second sections abutting against each other so as to form each of the interpole partitions when the middle cover is placed on the main case.

4. The circuit breaker as claimed in claim 2, wherein the intermediate partition is integrally provided with the middle cover, and the middle cover is brought into contact with an end of each of the interpole partitions in the main case across the poles so as to shield the contactor sections and the overcurrent tripping device from each other when middle cover is placed on the main case.

5. The circuit breaker as claimed in claim 2, wherein said middle cover further includes a bottom portion formed therewith for forming the recess, and inner walls for separating the recess into a plurality of spaces.

* * * * *